US010876795B2

(12) United States Patent
Ojiro

(10) Patent No.: US 10,876,795 B2
(45) **Date of Patent: *Dec. 29, 2020**

(54) HEAT EXCHANGER AND HEAT SOURCE DEVICE

(71) Applicant: RINNAI CORPORATION, Aichi (JP)

(72) Inventor: Takashi Ojiro, Aichi (JP)

(73) Assignee: RINNAI CORPORATION, Aichi (JP)

( * ) Notice: Subject to any disclaimer, the term of this patent is extended or adjusted under 35 U.S.C. 154(b) by 68 days.

This patent is subject to a terminal disclaimer.

(21) Appl. No.: 16/295,696

(22) Filed: Mar. 7, 2019

(65) Prior Publication Data

US 2019/0323778 A1 Oct. 24, 2019

(30) Foreign Application Priority Data

Apr. 23, 2018 (JP) ..... 2018-082164

(51) Int. Cl.

| | |
|---|---|
| ***F28F 3/00*** | (2006.01) |
| ***F28D 9/00*** | (2006.01) |
| ***F02M 26/29*** | (2016.01) |
| ***F28D 21/00*** | (2006.01) |

(52) U.S. Cl.

CPC ..... *F28D 9/0043* (2013.01); *F02M 26/29* (2016.02); *F28D 21/0003* (2013.01)

(58) Field of Classification Search

CPC .... F28D 9/0043; F28D 21/0003; F02M 26/29

USPC ..... 165/166

See application file for complete search history.

(56) References Cited

U.S. PATENT DOCUMENTS

| | | | | |
|---|---|---|---|---|
| 5,113,844 | A * | 5/1992 | Cook | F24H 3/105 126/110 R |
| 2007/0261400 | A1* | 11/2007 | Digele | F01N 3/05 60/320 |
| 2011/0259553 | A1* | 10/2011 | Filippone | F01N 5/02 165/104.21 |
| 2019/0323783 | A1* | 10/2019 | Ojiro | F28D 9/005 |

FOREIGN PATENT DOCUMENTS

| | | |
|---|---|---|
| KR | 10-1389465 | 4/2014 |

* cited by examiner

*Primary Examiner* — Davis D Hwu

(74) *Attorney, Agent, or Firm* — Wenderoth, Lind & Ponack, L.L.P.

(57) ABSTRACT

A heat exchanger disposed on a downstream side of a gas flow passage of combustion exhaust gas ejected from a burner comprising a plurality of heat exchange units stacked in a gas flow passage direction of the combustion exhaust gas, an inlet pipe, and an outlet pipe, wherein the inlet pipe and the outlet pipe are provided so as to protrude from a most downstream heat exchange unit located on a most downstream side of the gas flow passage of the combustion exhaust gas toward the downstream side of the gas flow passage of the combustion exhaust gas.

9 Claims, 7 Drawing Sheets

HEAT EXCHANGER AND HEAT SOURCE DEVICE

FIELD OF THE INVENTION

The present invention relates to a heat exchanger disposed on a downstream side of a gas flow passage of combustion exhaust gas ejected from a burner and a heat source device including the heat exchanger. Especially, the present invention relates to the heat exchanger having a stacked body formed by stacking a plurality of heat exchange units.

DESCRIPTION OF THE RELATED ART

Conventionally, a heat exchanger including a stacked body formed by stacking a plurality of heat exchange units in which an upper heat exchange plate and a lower heat exchange plate are joined has been proposed (for example, Patent Prior Art 1: KR 10-1389465 B1). Each of the heat exchange units has an internal space in which a fluid to be heated flows between the upper heat exchange plate and the lower heat exchange plate, and a plurality of gas vents penetrating the internal space in a non-communicating state and through which combustion exhaust gas passes.

Further, each of the heat exchange units has through holes substantially at a center in a front-rear direction at both ends in a left-right direction. The through holes of the heat exchange units disposed adjacent in a vertical direction face each other and are connected so as to communicate with each other. An inlet pipe for allowing the fluid to be heated to flow into the heat exchanger and an outlet pipe for allowing the fluid to be heated to flow out from the heat exchanger are connected to the through holes from above substantially at the center in the front-rear direction at both ends in the left-right direction of an uppermost heat exchange unit.

However, the heat exchanger in Patent prior art 1 has a combustion chamber of a predetermined height between the burner and the heat exchanger. Therefore, the inlet pipe and the outlet pipe connected to the uppermost heat exchange unit located at a most upstream side of a gas flow passage of the combustion exhaust gas project into the combustion chamber. With this configuration, flame of the burner contacts the low-temperature inlet pipe and the outlet pipe. As a result, carbon monoxide is generated due to the inlet pipe and the outlet pipe located above the heat exchanger, and combustion performance deteriorates. In particular, because the low-temperature fluid to be heated before being heated flows into the inlet pipe, the carbon monoxide is easy to generate. In addition, since the combustion exhaust gas comes into contact with the inlet pipe and the outlet pipe before flowing into the heat exchanger, a temperature of the combustion exhaust gas supplied into the heat exchanger decreases, and thermal efficiency tends to decrease.

It is considered that the height of the combustion chamber is increased to improve the combustion performance. However, the burner and the heat exchanger are further separated from each other, so that the temperature of the combustion exhaust gas supplied to the heat exchanger is lowered. As a result, there are problems that not only the thermal efficiency further decreases but a large installation space is required in a vertical direction to install a heat source device.

SUMMARY OF THE INVENTION

The present invention has been made to solve the problems described above, and an object of the present invention is to provide a heat exchanger capable of improving combustion performance and improving thermal efficiency, and a heat source device including the heat exchanger.

According to one aspect of the present invention, there is provided a heat exchanger disposed on a downstream side of a gas flow passage of combustion exhaust gas ejected from a burner and connected to an inlet pipe for allowing a fluid to be heated to flow in and an outlet pipe for allowing the fluid to be heated to flow out, the heat exchanger comprising a stacked body formed by stacking a plurality of heat exchange units in a gas flow passage direction of the combustion exhaust gas, wherein each of the plurality of heat exchange units includes:

an internal space in which the fluid to be heated flows, a plurality of gas vents penetrating the internal space in a non-communicating state and through which the combustion exhaust gas passes, at least one inlet port for allowing the fluid to be heated to flow into the internal space, and at least one outlet port for allowing the fluid to be heated to flow out from the internal space, wherein the internal spaces of adjacent heat exchange units communicate with each other via the outlet port of one heat exchange unit and the inlet port of another heat exchange unit, and the inlet pipe and the outlet pipe are provided so as to protrude from a most downstream heat exchange unit located on a most downstream side of the gas flow passage of the combustion exhaust gas, among the plurality of heat exchange units constituting the stacked body, toward the downstream side of the gas flow passage of the combustion exhaust gas.

According to another aspect of the present invention, there is provided a heat source device comprising the above-described heat exchanger.

Other objects, features and advantages of the present invention will become more fully understood from the detailed description given hereinbelow and the accompanying drawings which are given by way of illustration only, and thus are not to be considered as limiting the present invention.

DESCRIPTION OF EMBODIMENTS

Hereinafter, referring to drawings, a heat exchanger and a heat source device according to an embodiment of the present invention will be described in detail.

Figure 1:
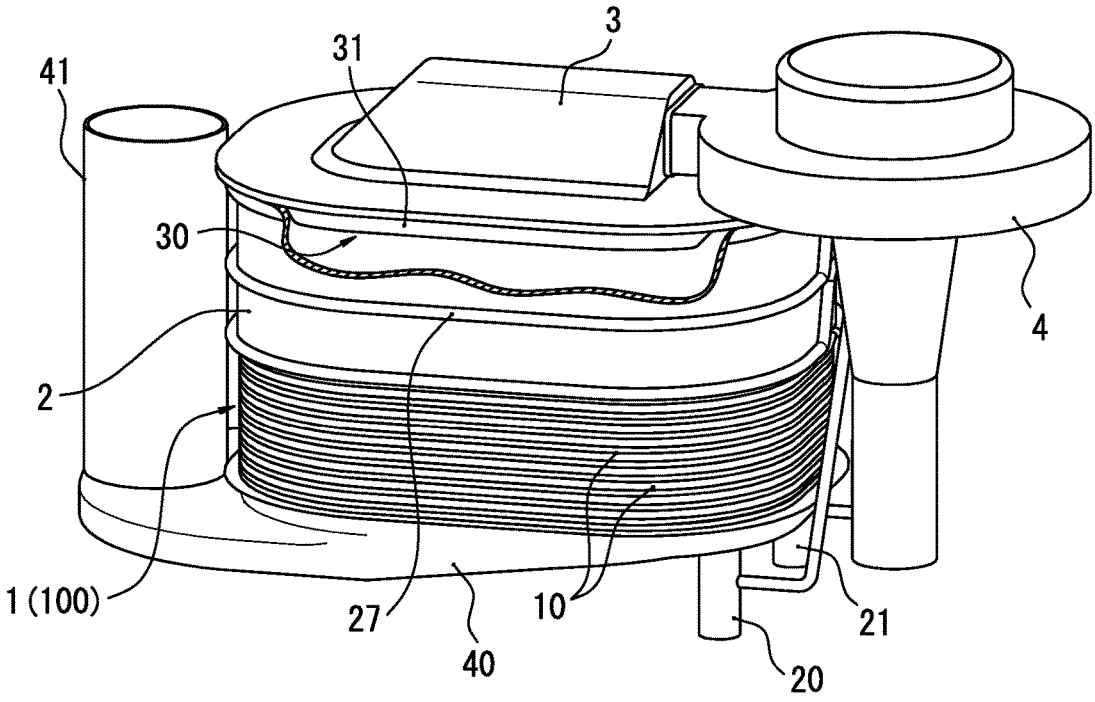
FIG. 1 is a schematic partial cut-away perspective view showing a heat source device according to an embodiment of the present invention.

As shown in FIG. 1, the heat source device according to the present embodiment is a water heater that heats water (a fluid to be heated) flowing into a heat exchanger 1 from an inlet pipe 20 by combustion exhaust gas generated by a burner 31 and supplies hot water to a hot water supplying terminal (not shown) such as a faucet or a shower through an outlet pipe 21. Although not shown, the water heater is accommodated in an outer casing. Other heating medium (for example, an antifreezing fluid) as the fluid to be heated may be used.

In this water heater, a burner body 3 constituting an outer shell of the burner 31, a combustion chamber 2, the heat exchanger 1, and a drain receiver 40 are disposed in order from the top. Additionally, a fan case 4 housing a combustion fan for feeding a mixture gas of fuel gas and air into the burner body 3 is disposed on one side (a right side in FIG. 1) of the burner body 3. Further, an exhaust duct 41 communicating with the drain receiver 40 is disposed on another side (a left side in FIG. 1) of the burner body 3. The combustion exhaust gas flowing out to the drain receiver 40 is discharged to an outside of the water heater through the exhaust duct 41.

In this specification, when the water heater is viewed in a state where the fan case 4 and the exhaust duct 41 are disposed on the sides of the burner body 3, a depth direction corresponds to a front-rear direction, a width direction corresponds to a left-right direction, and a height direction corresponds to a vertical direction.

The burner body 3 has a substantially oval shape in a plane view. The burner body 3 is made of stainless steel-based metal, for example. Although not shown, the burner body 3 opens downward.

An introducing unit communicating with the fan case 4 projects upward from a center of the burner body 3. The burner body 3 includes a flat burner 31 having a downward combustion surface 30. The mixture gas is supplied to the burner body 3 by rotating the combustion fan.

The burner 31 is of all primary air combustion type. The burner 31 includes a ceramic combustion plate having many flame ports opening downwardly (not shown) or a combustion mat made by knitting metal fabric woven like net. The mixture gas supplied into the burner body 3 is jetted downward from the downward combustion surface 30 by supply pressure of the combustion fan. By igniting the mixture gas, flame is formed on the combustion surface 30 of the burner 31 and the combustion exhaust gas is generated. Therefore, the combustion exhaust gas ejected from the burner 31 is fed to the heat exchanger 1 via the combustion chamber 2. Then, the combustion exhaust gas having passed through the heat exchanger 1 passes through the drain receiver 40 and the exhaust duct 41 and is discharged to the outside of the water heater.

In other words, in the heat exchanger 1, an upper side where the burner 31 is provided corresponds to an upstream side of a gas flow passage of the combustion exhaust gas, and a lower side opposite to the side provided with the burner 31 corresponds to a downstream side of the gas flow passage of the combustion exhaust gas.

Figure 5:
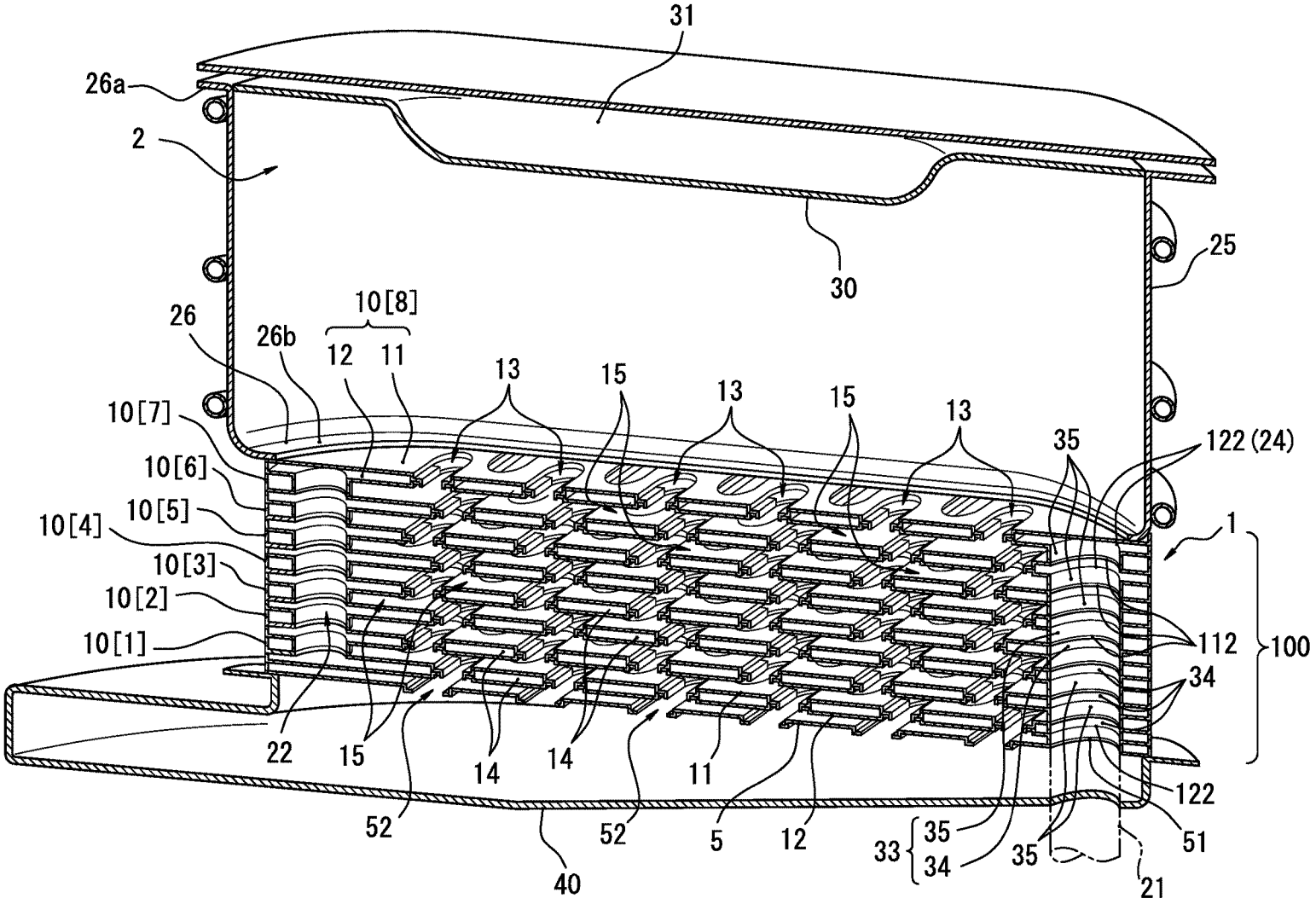
FIG. 5 is a schematic partial cross-sectional perspective view of an outlet pipe side showing the heat exchanger according to the embodiment of the present invention.

The combustion chamber 2 has a substantially oval shape in a plane view. The combustion chamber 2 is made of stainless steel-based metal, for example. The combustion chamber 2 having an upper opening and a lower opening is formed by bending one single metal plate having a substantially rectangular shape and joining both ends thereof. As shown in FIG. 5, a flange 26*a* bent outward is formed at an upper end of the combustion chamber 2, and a flange 26*b* bent inward is formed at a lower end of the combustion chamber 2. These flanges 26*a*, 26*b* are respectively joined to a lower surface peripheral edge of the burner body 3 and an upper surface peripheral edge of the heat exchanger 1.

Figure 4:
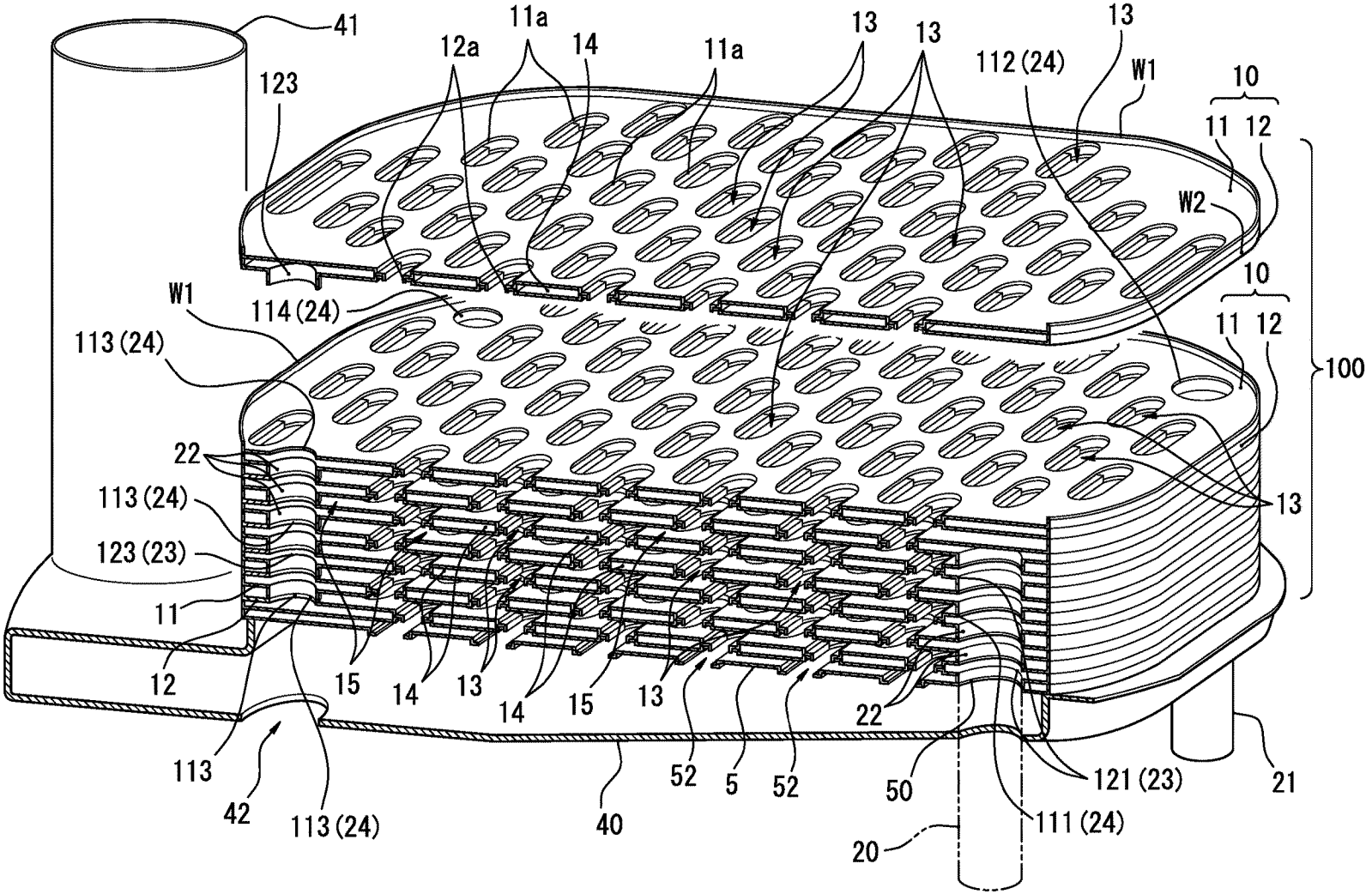
FIG. 4 is a schematic partial cross-sectional perspective view of an inlet pipe side showing the heat exchanger according to the embodiment of the present invention.

The heat exchanger 1 has a substantially oval shape in a plane view. As shown in FIGS. 4 and 5, the heat exchanger 1 has a stacked body 100 formed by stacking a plurality of (in this embodiment, eight) heat exchange units 10 and a deflection plate 5 connected to a lower side of a lowermost heat exchange unit 10. The heat exchanger 1 may have a housing surrounding an outer circumference thereof.

Each of the heat exchange units 10 is formed by superimposing a pair of upper heat exchange plate 11 and lower heat exchange plate 12 in the vertical direction and joining predetermined portions to be described later with a brazing material or the like. The upper and lower heat exchange plates 11, 12 of each of the heat exchange units 10 respectively have a common configuration, except that some configuration such as a position of a gas vent is different. Therefore, the common configuration will be described first, and the different configuration will be described later. For clarity sake, the dimensions of elements which are represented in the figures do not correspond to the actual dimensions, and do not limit the embodiment.

Figure 3:
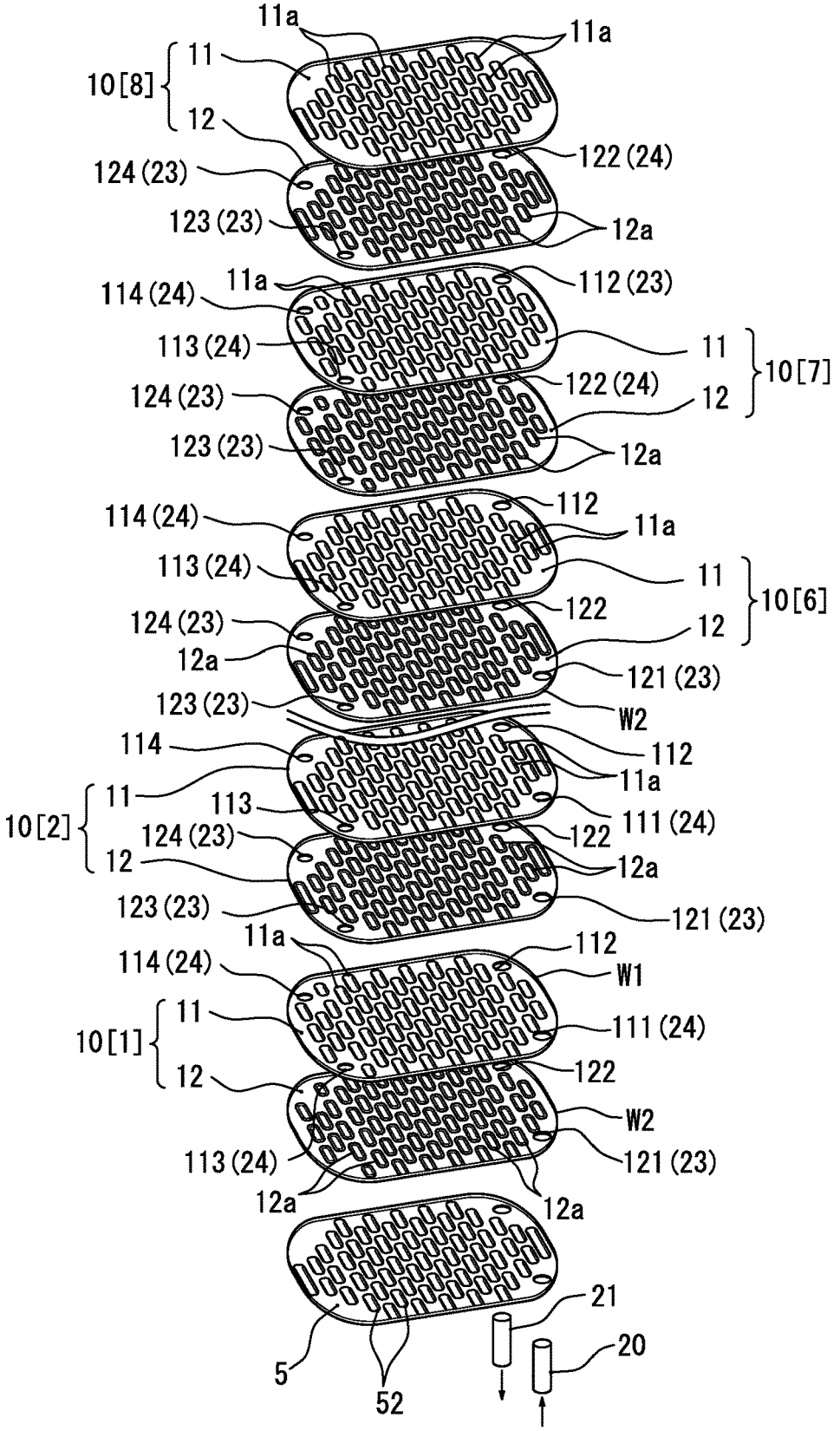
FIG. 3 is a schematic partial exploded perspective view showing heat exchange units of the heat exchanger according to the embodiment of the present invention.

As shown in FIG. 3, the upper and lower heat exchange plates 11, 12 respectively have a substantially oval shape in a plane view. The upper and lower heat exchange plates 11, 12 are made of stainless steel-based metal, for example. The upper and lower heat exchange plates 11, 12 respectively have a number of substantially elongated hole-shaped upper and lower gas vents 11*a*, 12*a* on substantially entire surfaces of the plates except corners. The upper and lower gas vents 11*a*, 12*a* are formed in such a manner that long sides extend in the front-rear direction.

Further, as will be described later, the upper and lower heat exchange plates 11, 12, except for an upper heat exchange plate 11 of an uppermost heat exchange unit 10, respectively have substantially circular upper and lower through holes in at least one corner. These upper and lower gas vents 11*a*, 12*a* and a part of the upper and lower through holes are formed by burring so that joints (burring portions) projecting upward or downward from opening edges are formed.

Figure 2:
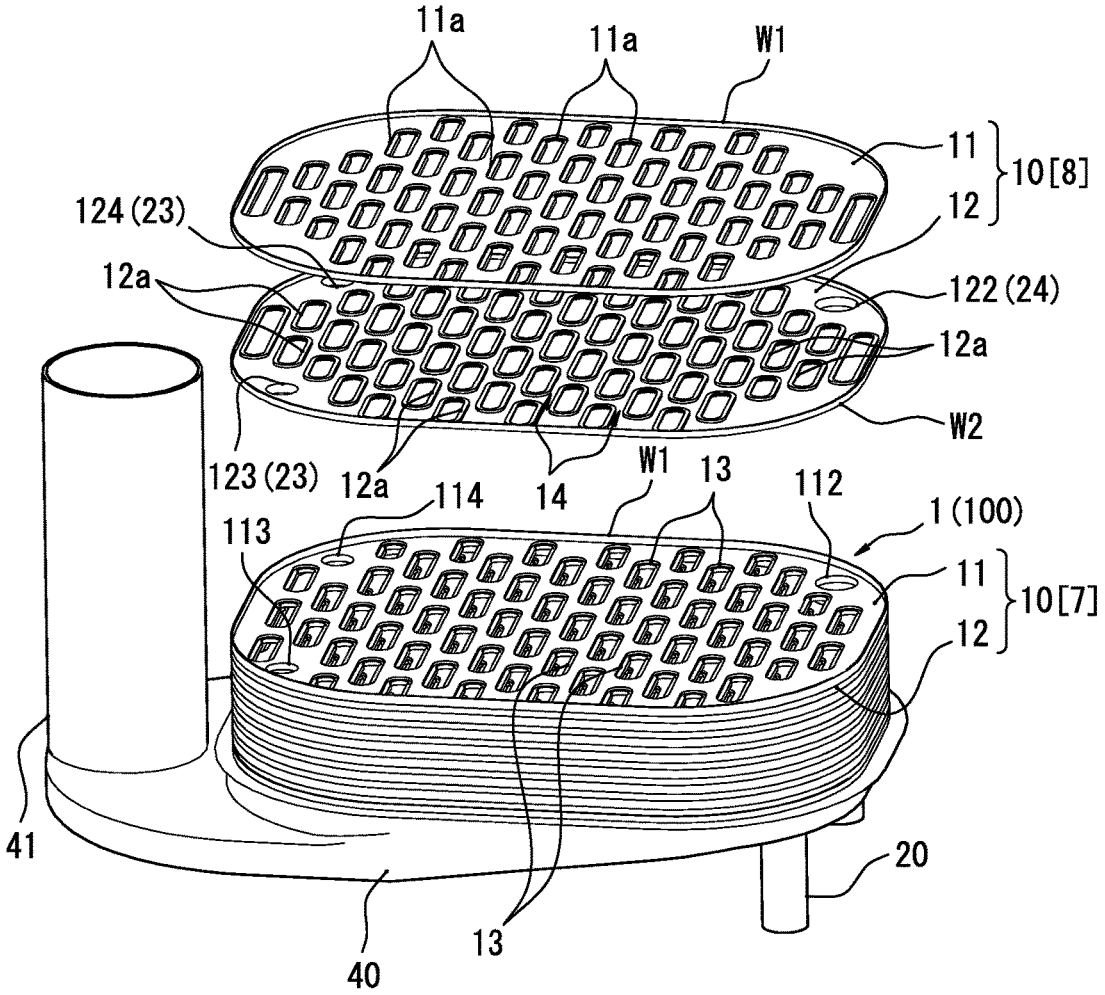
FIG. 2 is a schematic partial exploded perspective view showing a heat exchanger according to the embodiment of the present invention.

As shown in FIG. 2, the upper and lower gas vents 11*a*, 12*a* of the upper and lower heat exchange plates 11, 12 of each of the heat exchange units 10 are provided at positions facing each other. Although not shown, the upper gas vent 11*a* of the upper heat exchange plate 11 has an upper gas vent joint projecting downward at a peripheral edge, and the lower gas vent 12*a* of the lower heat exchange plate 12 has a lower gas vent joint projecting upward at a peripheral edge. Further, upper and lower peripheral edge joints W1, W2 projecting upward are respectively formed on peripheral edges of the upper and lower heat exchange plates 11, 12. The upper and lower heat exchange plates 11, 12 are set in such a manner that when the upper gas vent joints and the lower gas vent joints are joined and further the lower peripheral edge joint W2 and a bottom surface peripheral edge of the upper heat exchange plate 11 are joined, the upper and lower heat exchange plates 11, 12 are spaced from each other at a gap with a predetermined height.

Further, as shown in FIGS. 4 and 5, the upper peripheral edge joint W1 of the upper heat exchange plate 11 is set in such manner that when the upper peripheral edge joint W1 of the upper heat exchange plate 11 and a bottom surface peripheral edge of the lower heat exchange plate 12 of an upward adjacent heat exchange unit 10 are joined, the upper heat exchange plate 11 of the lower heat exchange unit 10 and the lower heat exchange plate 12 of the upper heat exchange unit 10 are spaced from each other at a gap with a predetermined height. Therefore, by joining the upper and lower gas vent joints of the upper and lower gas vents 11*a*, 12*a* of the upper and lower heat exchange plates 11, 12, and by joining the lower peripheral edge joint W2 of the lower heat exchange plate 12 and the bottom surface peripheral edge of the upper heat exchange plate 11, an internal space 14 of a predetermined height and an gas vent 13 penetrating the internal space 14 in a non-communicating state are formed. Furthermore, by joining the plurality of heat exchange units 10, an exhaust space 15 in which the combustion exhaust gas passing through the gas vent 13 flows is formed between vertically adjacent heat exchange units 10.

The gas vents 13 of the vertically adjacent heat exchange units 10 are shifted by a half pitch in the left-right direction perpendicularly intersecting a gas flow passage direction of the combustion exhaust gas. Therefore, the combustion exhaust gas flowing from above passes through the gas vent 13 of the one heat exchange unit 10, and then flows out to the exhaust space 15 between the one heat exchange unit 10 and a downward adjacent heat exchange unit 10. Then, the combustion exhaust gas flowing out to the exhaust space 15 collides with the upper heat exchange plate 11 of the downward adjacent heat exchange unit 10 and further flows downward from the gas vent 13 of the downward adjacent heat exchange unit 10. In other words, when the combustion exhaust gas flows from an upper side to a lower side in the stacked body 100, a zigzag-shaped exhaust passage is formed in the stacked body 100. As a result, a contact time between the combustion exhaust gas in the heat exchanger 1 and the upper and lower heat exchange plates 11, 12 increases.

Next, the heat exchange unit 10 in each layer will be described with reference to FIG. 3.

Note that a number in a square bracket ([ ]) on a right side of the heat exchange unit 10 in FIGS. 3 and 5 indicates the number of layers from the bottom when the lowermost heat exchange unit 10 is a first layer.

The lower heat exchange plate 12 which is an element of the first (lowermost) heat exchange unit 10 has lower through holes 121, 122 in front and rear corners on a right side (right short side) in FIG. 3. Further, the upper heat exchange plate 11 of the first heat exchange unit 10 has upper through holes 111 to 114 in four corners. Note that, when the upper and lower heat exchange plates 11, 12 are superimposed with each other, the upper and lower through holes located in the same corner of the upper and lower heat exchange plates 11, 12 of the heat exchange units 10 including the first heat exchange unit 10 are opened so as to be located on a coaxial line.

Further, the two lower through holes 121, 122 each have a lower joint projecting downward from an opening edge, and the upper through hole 112 in a rear corner on a right side of the upper heat exchange plate 11 has an upper joint projecting downward from an opening edge. This upper joint has a height abutting against an upper surface of the lower heat exchange plate 12, when the first upper and lower heat exchange plates 11, 12 are joined together.

Therefore, as described above, when the upper and lower gas vent joints of the upper and lower gas vents 11*a*, 12*a* of the upper and lower heat exchange plates 11, 12 forming the first heat exchange unit 10 are joined, the lower peripheral edge joint W2 of the lower heat exchange plate 12 and the bottom surface peripheral edge of the upper heat exchange plate 11 are joined, and further the upper joint of the upper through hole 112 in the rear corner on the right side of the upper heat exchange plate 11 and the upper surface of the lower heat exchange plate 12 are joined, an internal space 14 of the first heat exchange unit 10 communicates with the lower through hole 121 in the front corner on the right side of the lower heat exchange plate 12, and communicates with the three upper through holes 111, 113, 114 other than the upper through hole 112 in the rear corner on the right side of the upper heat exchange plate 11.

Further, by joining the upper joint of the upper through hole 112 in the rear corner on the right side of the upper heat exchange plate 11 and a peripheral edge of the lower through hole 122 in the rear corner on the right side of the lower heat exchange plate 12, a flow path 34 defined in a non-communicating state with the internal space 14 is formed. Therefore, when the inlet pipe 20 is connected to the lower joint of the lower through hole 121 in the front corner on the right side of the lower heat exchange plate 12 via the deflection plate 5 to be described later, water flows into the internal space 14 of the first heat exchange unit 10 from the inlet pipe 20. Then, the water flows out upward from the internal space 14 via the upper through holes 111, 113, 114 other than the upper through hole 112 in the rear corner on the right side of the upper heat exchange plate 11.

In other words, in the first heat exchange unit 10, an inlet port 23 through which the water flows into the internal space 14 is formed by the one lower through hole 121 in the front corner on the right side of the lower heat exchange plate 12. In addition, outlet ports 24 through which the water flows out from the internal space 14 are formed by the three upper through holes 111, 113, 114 in a front corner on the right side and front and rear corners on a left side of the upper heat exchange plate 11.

In the first heat exchange unit 10, the two outlet ports 24 in the front and rear corners on the left side (that is, the upper through holes 113, 114 in the front and rear corners on the left side of the upper heat exchange plate 11) among the three outlet ports 24 are located to be spaced apart from the inlet port 23 in the front corner on the right side (that is, the lower through hole 121 in the front corner on the right side of the lower heat exchange plate 12) in the left-right direction. Further, among the two outlet ports 24 located apart from the inlet port 23 in the left-right direction, the outlet port 24 formed by the upper through hole 114 in the rear corner on the left side is located on a substantially diagonal line of the heat exchange unit 10 with respect to the inlet port 23. Therefore, the water flowing into the internal space 14 from the inlet port 23 formed by the lower through hole 121 in the front corner on the right side flows toward the outlet port 24 formed by the upper through hole 113 in the front corner on the left side located in the same front as the inlet port 23, the outlet port 24 formed by the upper through hole 114 in the rear corner on the left side located on the substantially diagonal line with respect to the inlet port 23, and the outlet port 24 in the front corner on the right side to be described later.

As described above, in the first heat exchange unit 10, the water flows in the internal space 14 in the left-right direction, while spreading from the one inlet port 23 toward the two outlet ports 24 located apart from each other in the front-rear direction. Therefore, a partial short circuit of the water flowing in the left-right direction in the internal space 14 is suppressed, and a uniform water flow distribution can be obtained.

Also, since the substantially elongated hole-shaped gas vent 13 is provided so that its long side extends in the front-rear direction, a direction in which the long side of the gas vent 13 extends is substantially orthogonal to a flow path direction of the water flowing in the internal space 14. Accordingly, the water flowing into the internal space 14 from the inlet port 23 collides with the long side of the gas vent 13, thereby flowing to the two outlet ports 24 distant from each other in the front-rear direction while the flow path direction of the water is curved. Therefore, the water flowing in the internal space 14 spreads further in the entire internal space 14. As a result, the water easily flows to both ends in the front-rear direction of the internal space 14. Thus, the water is efficiently heated. In addition, since a curved flow is formed, a fluid flow path becomes longer. As a result, a heat absorption time increases, and thermal efficiency improves.

In second to fifth heat exchange units 10, upper and lower heat exchange plates 11, 12 of the heat exchange units 10 have the same configuration, except that upper and lower gas vents 11*a*, 12*a* as described above are shifted by a half pitch in the left-right direction from those of the vertically adjacent heat exchange units 10.

Further, the upper and lower heat exchange plates 11, 12 have four upper through holes 111 to 114 and four lower through holes 121 to 124 at substantially the same positions as the upper through holes 111 to 114 in the four corners of the first upper heat exchange plate 11. Further, the four lower through holes 121 to 124 in four corners of each of those lower heat exchange plates 12 have lower joints projecting downward from opening edges. Moreover, the upper through hole 112 in a rear corner on a right side of each of those upper heat exchange plates 11 has an upper joint projecting downward from an opening edge, same as the first upper heat exchange plate 11. Heights of those upper and lower joints and upper and lower peripheral edge joints W1, W2 of the second to fifth heat exchange units 10 are the same as those of the first heat exchange unit 10.

Therefore, in each of the second to fifth heat exchange unit 10, when upper and lower gas vent joints of upper and lower gas vents 11*a*, 12*a* of the upper and lower heat exchange plates 11, 12 are joined, the lower peripheral edge joint W2 of the lower heat exchange plate 12 and a bottom surface peripheral edge of the upper heat exchange plate 11 are joined, and further the upper joint of the upper through hole 112 in the rear corner on the right side of the upper heat exchange plate 11 and an upper surface of the lower heat exchange plate 12 are joined, an internal space 14 formed between the upper and lower heat exchange plates 11, 12 communicates with the three lower through holes 121, 123, 124 in a front corner on a right side and in front and rear corners on a left side of the lower heat exchange plate 12, and communicates with the three upper through holes 111, 113, 114 in a front corner on the right side and front and rear corners on a left side of the upper heat exchange plate 11.

Further, each of the lower joints projecting downward from the opening edges of the four lower through holes 121 to 124 of each of the lower heat exchange plates 12 in the second to fifth heat exchange units 10 has a height abutting against an upper surface of the upper heat exchange plate 11 of a downward adjacent heat exchange unit 10, when the heat exchange units 10 are stacked in the vertical direction.

Accordingly, when the lower joints of the three lower through holes 121, 123, 124 in the front corner on the right side and the front and rear corners on the left side of the lower heat exchange plate 12 of one of the second to fifth heat exchange units 10 and the upper surface of the upper heat exchange plate 11 of the downward adjacent heat exchange unit 10 (including the upper heat exchange plate 11 of the first heat exchange unit 10) are joined, and a bottom peripheral edge of the lower heat exchange plate 12 and the upper peripheral edge joint W1 of the upper heat exchange plate 11 of the downward adjacent heat exchange unit 10 are joined, as shown in FIG. 4, an exhaust space 15 as described above and communication paths 22 defined in a non-communicating state with the exhaust space 15 are formed between the vertically adjacent heat exchange units 10.

In other words, in each of the second to fifth heat exchange units 10, inlet ports 23 through which the water flows into the internal space 14 are formed by the three lower through holes 121, 123, 124 in the front corner on the right side and the front and rear corners on the left side of the lower heat exchange plate 12. Further, outlet ports 24 through which the water flows out from the internal space 14 are formed by the three upper through holes 111, 113, 114 of the upper heat exchange plate 11 facing the lower through holes 121, 123, 124.

Further, by joining the lower joints of these three inlet ports 23 (that is, the lower through holes 121, 123, 124 in the front corner on the right side and the front and rear corners on the left side of the lower heat exchange plate 12) and the upper surface of the upper heat exchange plate 11 of the downward adjacent heat exchange unit 10, the communication paths 22 for allowing the internal spaces 14 of the vertically adjacent heat exchange units 10 to communicate with each other are formed.

Further, as shown in FIG. 5, by joining a lower joint of a lower through hole 122 in a rear corner on the right side of the lower heat exchange plate 12 and a peripheral edge of the upper through hole 112 in the rear corner on the right side of the upper heat exchange plate 11 of the downward adjacent heat exchange unit 10, a flow path 35 defined in a non-communicating state with the exhaust space 15 between the vertically adjacent heat exchange units 10 is formed.

Further, by joining the upper joint of the upper through hole 112 in the rear corner on the right side of the upper heat exchange plate 11 and a peripheral edge of the lower through hole 122 in the rear corner on the right side of the lower heat exchange plate 12, a flow path 34 defined in a non-communicating state with the internal space 14 is formed.

Therefore, in the second to fifth heat exchange units 10, same as the first heat exchange unit 10, a part of the water flowing into the internal space 14 from the inlet port 23 in the front corner on the right side flows, while colliding with the gas vents 13, toward the outlet port 24 in the front corner on the left side located in the same front as the inlet port 23 and the outlet port 24 in the rear corner on the left side located on the substantially diagonal line with respect to the inlet port 23.

In a sixth heat exchange unit 10 located at a third layer from the top in FIG. 3, upper and lower heat exchange plates 11, 12 have the same configuration as those of the second heat exchange unit 10, except that an upper through hole is not formed in a front corner on a right side of the upper heat exchange plate 11. Therefore, in a sixth heat exchange unit 10, when upper and lower gas vent joints of upper and lower gas vents 11*a*, 12*a* of the upper and lower heat exchange plates 11, 12 are joined, a lower peripheral edge joint W2 of the lower heat exchange plate 12 and a bottom surface peripheral edge of the upper heat exchange plate 11 are joined, and further an upper joint of an upper through hole 112 in a rear corner on the right side of the upper heat exchange plate 11 and an upper surface of the lower heat exchange plate 12 are joined, an internal space 14 formed between the upper and lower heat exchange plates 11, 12 communicates with three lower through holes 121, 123, 124 in a front corner on a right side and front and rear corners on a left side of the lower heat exchange plate 12, and communicates with two upper through holes 113, 114 in front and rear corners on a left side of the upper heat exchange plates 11. Further, by joining the upper joint of the upper through hole 112 in the rear corner on the right side of the upper heat exchange plate 11 and an upper surface of the lower heat exchange plate 12, a flow path 34 defined in a non-communicating state with the internal space 14 is formed.

Further, similarly to the above, when the fifth and sixth heat exchange units 10 are joined together, an exhaust space 15 as described above and paths defined in a non-communicating state with the exhaust space 15 are formed. In other words, in the sixth heat exchange unit 10, inlet ports 23 through which the water flows into the internal space 14 are formed by the three lower through holes 121, 123, 124 in the front corner on the right side and the front and rear corners on the left side of the lower heat exchange plate 12. Further, outlet ports 24 through which the water flows out from the internal space 14 are formed by the two upper through holes 113, 114 in the front and rear corners on the left side of the upper heat exchange plate 11. Moreover, by joining the lower joints of these three inlet ports 23 (that is, the lower through holes 121, 123, 124 in the front corner on the right side and the front and rear corners on the left side of the lower heat exchange plate 12) and the upper surface of the upper heat exchange plate 11 of the downward adjacent fifth heat exchange unit 10, communication paths 22 for allowing the internal spaces 14 of the vertically adjacent heat exchange units 10 to communicate with each other are formed.

Further, by joining a lower joint of a lower through hole 122 in a rear corner on the right side of the lower heat exchange plate 12 and a peripheral edge of the upper through hole 112 in the rear corner on the right side of the upper heat exchange plate 11 of the downward adjacent fifth heat exchange unit 10, a flow path 35 defined in a non-communicating state with the exhaust space 15 between the vertically adjacent heat exchange units 10 is formed.

In the first to sixth heat exchange units 10, when these heat exchange units 10 are stacked, the inlet port 23 and the outlet port 24 in the front corner on the right side are located on a coaxial line. Therefore, a part of the water flowing into the internal space 14 of the first heat exchange unit 10 flows linearly toward the upper outlet port 24, and flows into the internal space 14 of each of the second to sixth heat exchange units 10 from the outlet port 24 through the communication path 22. Therefore, a part of the water flowing into the first to sixth heat exchange units 10 flows in the same direction (the right to the left in the drawing) of the left-right direction within each of the heat exchange units 10. Thereby, a downstream heat exchange block in which the water flows in the same direction within the internal space 14 is formed.

In a seventh heat exchange unit 10, upper and lower heat exchange plates 11, 12 have the same configuration as those of the fifth heat exchange unit, except that a lower through hole is not formed in a front corner on a right side of the lower heat exchange plate 12, that an upper through hole is not formed in a front corner on a right side of the upper heat exchange plate 11, and that an upper joint is not formed in an upper through hole 112 in a rear corner on the right side of the upper heat exchange plate 11. Therefore, in the seventh heat exchange unit 10, when upper and lower gas vent joints of upper and lower gas vents 11*a*, 12*a* of the upper and lower heat exchange plates 11, 12 are joined, and a lower peripheral edge joint W2 of the lower heat exchange plate 12 and a bottom surface peripheral edge of the upper heat exchange plate 11 are joined, an internal space 14 formed between the upper and lower heat exchange plates 11, 12 communicates with all upper and lower through holes 112, 113, 114, 122, 123, 124.

Further, similarly to the above, when the sixth and seventh heat exchange units 10 are joined together, an exhaust space 15 as described above and paths defined in a non-communicating state with the exhaust space 15 are formed. In other words, in the seventh heat exchange unit 10, inlet ports 23 through which the water flows into the internal space 14 are formed by the two lower through holes 123, 124 in front and rear corners on a left side of the lower heat exchange plate 12. Further, outlet ports 24 through which the water flows out from the internal space 14 are formed by the two upper through holes 113, 114 in front and rear corners on a left side of the upper heat exchange plate 11. Moreover, by joining lower joints of these two inlet ports 23 (that is, the lower through holes 123, 124 in the front and rear corners on the left side of the lower heat exchange plate 12) and the upper surface of the upper heat exchange plate 11 of the downward adjacent sixth heat exchange unit 10, communication paths 22 for allowing the internal spaces 14 of the vertically adjacent heat exchange units 10 to communicate with each other are formed.

Further, by joining a lower joint of the lower through hole 122 in a rear corner on the right side of the lower heat exchange plate 12 and a peripheral edge of the upper through hole 112 in the rear corner on the right side of the upper heat exchange plate 11 of the downward adjacent sixth heat exchange unit 10, a flow path 35 defined in a non-communicating state with the exhaust space 15 between the vertically adjacent heat exchange units 10 is formed. The flow path 35 communicates with the internal space 14 of the seventh heat exchange unit 10. Since an upper joint is not formed in an opening edge of the upper through hole 112, an outlet port 24 for allowing the water to flow from the internal space 14 of the seventh heat exchange unit 10 to the internal space 14 of the sixth heat exchange unit 10 is formed by the lower through hole 122.

As described above, the lower heat exchange plate 12 of the seventh heat exchange unit 10 has no lower through hole in the front corner on the right side, different from those of the first to sixth heat exchange units. Therefore, in the seventh heat exchange unit 10, a part of the water flowing into the internal space 14 from the two inlet ports 23 in the front and rear corners on the left side flows, while colliding with gas vents 13, toward the outlet port 24 in the rear corner on the right side of the lower heat exchange plate 12 located on a substantially diagonal line with respect to the inlet port 23 in the front corner on the left side in a direction opposite to the direction of the water flowing in the internal spaces 14 of the first to sixth heat exchange units 10 (from the left to the right in the drawing).

In an eighth (uppermost) heat exchanger unit 10 located on a most upstream side of the gas flow passage of the combustion exhaust gas, upper and lower heat exchange plates 11, 12 have the same configuration as those of the sixth heat exchange unit 10, except that a lower through hole is not formed in a front corner on a right side of the lower heat exchange plate 12 and that an upper through hole is not formed in the upper heat exchange plate 11. Therefore, in the eighth heat exchanger unit 10, when upper and lower gas vent joints of upper and lower gas vents 11*a*, 12*a* of the upper and lower heat exchange plates 11, 12 are joined, and a lower peripheral edge joint W2 of the lower heat exchange plate 12 and a bottom surface peripheral edge of the upper heat exchange plate 11 are joined, an internal space 14 formed between the upper and lower heat exchange plates 11, 12 communicates with all lower through holes 122, 123, 124.

Further, similarly to the above, when the seventh and eighth heat exchange units 10 are joined together, an exhaust space 15 as described above and paths defined in a non-communicating state with the exhaust space 15 are formed. In other words, in the eighth heat exchange unit 10, inlet ports 23 through which the water flows into the internal space 14 are formed by the two lower through holes 123, 124 in front and rear corners on a left side of the lower heat exchange plate 12. Further, an outlet port 24 through which the water flows out from the internal space 14 is formed by the lower through holes 122 in a rear corner on the right side of the lower heat exchange plate 12. Moreover, by joining lower joints of these two inlet ports 23 (that is, the lower through holes 123, 124 in the front and rear corners on the left side of the lower heat exchange plate 12) and an upper surface of the upper heat exchange plate 11 of the downward adjacent seventh heat exchange unit 10, communication paths 22 for allowing the internal spaces 14 of the vertically adjacent heat exchange units 10 to communicate with each other are formed.

Further, by joining a lower joint of the lower through hole 122 in the rear corner on the right side of the lower heat exchange plate 12 and a peripheral edge of the upper through hole 112 in the rear corner on the right side of the upper heat exchange plate 11 of the downward adjacent seventh heat exchange unit 10, a flow path 35 defined in a non-communicating state with the exhaust space 15 between the vertically adjacent heat exchange units 10 is formed. The flow path 35 communicates with the internal spaces 14 of the seventh and eighth heat exchange units 10.

In the eighth heat exchange unit 10, same as the seventh heat exchange unit 10, the water flowing into the internal space 14 from the two inlet ports 23 in the front and rear corners on the left side flows, while colliding with gas vents 13, toward the outlet port 24 in the rear corner on the right side of the lower heat exchange plate 12 located on a substantially diagonal line with respect to the inlet port 23 in the front corner on the left side.

In the seventh to eighth heat exchange units 10, when these heat exchange units 10 are stacked, the inlet ports 23 and the outlet ports 24 in the front and rear corners on the left side are located on coaxial lines, respectively. Therefore, apart of the water flowing into the internal space 14 of the seventh heat exchange unit 10 flows linearly toward the upper outlet ports 24, and flows into the internal space 14 of the eighth heat exchange unit 10 from the outlet ports 24 through the communication paths 22. Therefore, the water flowing into the seventh to eighth heat exchange units 10 flows in the same direction (the left to right in the drawing) of the left-right direction within each of the heat exchange units 10.

Further, the outlet port 24 in the rear corner on the right side of the eighth heat exchange unit 10 communicates with the internal space 14 of the seventh heat exchange unit 10 via the flow path 35 defined in the non-communicating state with the exhaust space 15 between the seventh and eighth heat exchange units 10 as described above and the upper through hole 112 in the rear corner on the right side of the upper heat exchange plate 11 of the seventh heat exchange unit 10. Therefore, a communication path through which the water flows from an upper side to a lower side is formed by the above flow path 35, whereby the flow path direction of the water is folded back in the stacked body 100. The outlet ports 24 in the rear corners on the right side of these seventh and eighth heat exchange units 10 (that is, the lower through holes 122 in the rear corners on the right side of these lower heat exchange plates 12) are located above the flow paths 34 defined in the non-communicating state with the internal spaces 14 of the first to sixth heat exchange units 10 and the flow paths 35 defined in the non-communicating state with the exhaust spaces 15 between the vertically adjacent heat exchange units 10 of the first to seventh heat exchange units 10.

Furthermore, the flow path 34 defined in the non-communicating state with the internal space 14 of the first heat exchange unit 10 communicates with the lower through hole 122 in the rear corner on the right side of the lower heat exchange plate 12 of the first heat exchange unit 10.

Therefore, the water flowing out from the outlet ports 24 in the rear corners on the right side of the seventh and eighth heat exchange units 10 flows downward through the flow paths 34, 35 respectively penetrating the internal spaces 14 of the heat exchange units 10 located below these outlet ports 24 and the exhaust space 15 between the heat exchange units 10 located below these outlet ports 24 in the non-communicating state.

In other words, a part of the water flowing from the lower side to the upper side in the stacked body 100 flows out to the flow path 35 from the seventh heat exchange unit 10 without flowing into the eighth heat exchange unit 10. Therefore, in the present embodiment, the uppermost eighth heat exchange unit 10 (that is, a most upstream heat exchange unit 10) and the seventh heat exchange unit 10 (that is, a second layer adjacent to the most upstream heat exchange unit 10) communicating with the outlet port 24 of the eighth heat exchange unit 10 via the flow path 35 form a burner side-heat exchange block which is an upstream heat exchange block located on the upstream side of the gas flow passage of the combustion exhaust gas. Specifically, the heat exchanger 1 is formed by stacking the burner side-heat exchange block constituted by the seventh and eighth heat exchange units 10 and a downstream heat exchange block constituted by the first to sixth heat exchange units 10. Note that three or more heat exchange blocks may be stacked.

Further, a part of the water flowing in the seventh heat exchange unit 10 does not flow into the eighth heat exchange unit 10 and flows out from the outlet port 24 in the rear corner on the right side of the seventh heat exchange unit 10. Therefore, the outlet port 24 of the eighth heat exchange unit 10 and the outlet port 24 in the rear corner on the right side of the seventh heat exchange unit 10 communicating with the outlet port 24 of the eighth heat exchange unit 10 via the flow path 35 (that is, the lower through holes 122 in the rear corners on the right side of the lower heat exchange plates 12 of these heat exchange units 10) form final outlet ports through which the water flows out to the outlet pipe 21 via an outflow path 33 to be described below.

Further, a joint body located on a coaxial line with the final outlet ports and formed by joining the flow path 34 penetrating the internal spaces 14 of the first to sixth heat exchange units 10 in the non-communicating state and the flow path 35 penetrating the exhaust spaces 15 between the first to seventh heat exchange units 10 in the non-communicating state forms the outflow path 33.

The deflection plate 5 is disposed below the first heat exchange unit 10. The deflection plate 5 has the same configuration as those of the lower heat exchange plate 12 of the first heat exchange unit 10, except that passing holes 52 are shifted by a half pitch in the left-right direction from the gas vents 13 of the first heat exchange unit 10. Therefore, two through holes 50, 51 in front and rear corners on a right side of the deflection plate 5 and the lower through holes 121, 122 in the front and rear corners on the right side of the lower heat exchange plate 12 of the first heat exchange unit 10 are located on coaxial lines, respectively.

By joining the lower joints of the two lower through holes 121, 122 in the front and rear corners on the right side of the lower heat exchange plate 12 of the first heat exchange unit 10 and peripheral edges of the two through holes 50, 51 of the deflection plate 5, respectively, an exhaust space 15 and paths defined in a non-communicating state with the exhaust space 15 between the first heat exchange unit 10 and the deflection plate 5 are formed. Therefore, the combustion exhaust gas ejected from the burner 31 flows downward from the eighth heat exchange unit 10 to the first heat exchange unit 10, while heating those heat exchange units 10 in the stacked body 100. Further, the combustion exhaust gas passing through the gas vents 13 of the lowermost heat exchange unit 10 flows in the exhaust spaces 15 between the lower heat exchange plate 12 of the lowermost heat exchange unit 10 and the deflection plate 5. Thus, even the lowermost heat exchange unit 10 can heat the water flowing in the internal space 14 from both upper and lower surfaces, and thermal efficiency can be further improved.

The inlet port 23 of the lowermost heat exchange unit 10 is connected to the inlet pipe 20 via the through hole 50 in the front corner on the right side of the deflection plate 5. Further, an lower end of the outflow path 33 is connected to the outlet pipe 21 via the through hole 51 in the rear corner on the right side of the deflection plate 5.

According to the heat exchanger 1 having the above configuration, the water supplied from the inlet pipe 20 flows into the stacked body 100 via the inlet port 23 of the first heat exchange unit 10. In addition, in the vertically adjacent heat exchange units 10, at least one outlet port 24 of the one heat exchange unit 10 and at least one inlet port 23 of the other heat exchange unit 10 are connected to each other via the communication path 22. Accordingly, the water flowing from the inlet pipe 20 into the lowermost heat exchange unit 10 flows from the lower side to the upper side (the downstream side to the upstream side of the gas flow passage of the combustion exhaust gas) in the stacked body 100. Further, the water flowing from the lower side to the upper side in the stacked body 100 flows out from the final outlet ports of the seventh and eighth heat exchange units 10 constituting the burner side-heat exchange block to the outlet pipe 21 via the outflow path 33 formed so as to penetrate the stacked body 100 below the seventh and eighth heat exchange units 10.

Therefore, both the inlet pipe 20 and the outlet pipe 21 protrude downward from the first heat exchange unit 10 (that is, a most downstream heat exchange unit 10) on a side opposite to the burner 31 side. As a result, since the inlet pipe 20 and the outlet pipe 21 are not provided between the burner 31 and the heat exchanger 1, the flame of the burner 31 can be prevented from contacting with the inlet pipe 20 and the outlet pipe 21. Further, before the combustion exhaust gas is supplied to the heat exchanger 1, the combustion exhaust gas can be prevented from coming into contact with the inlet pipe 20 and the outlet pipe 21.

In addition, the outflow path 33 penetrates the internal spaces 14 of the first to sixth heat exchange units 10 below the seventh and eighth heat exchange units 10 constituting the burner side-heat exchange block in the non-communicating state. Therefore, most heated water flowing from the burner side-heat exchange block located on the upstream side of the gas flow passage of the combustion exhaust gas to the outflow path 33 is not mixed with insufficiently heated water flowing in the internal spaces 14 of the lower first to sixth heat exchange units 10. Thereby, thermal efficiency can be improved.

In addition, a vacant space of a certain size is generally formed under the water heater. Therefore, even when the straight tubular inlet pipe 20 and the straight tubular outlet pipe 21 are vertically extended downward from the first heat exchange unit 10, it is possible to avoid interference between these pipes and other devices. As a result, it is possible to use a pipe having less bent structure for the inlet pipe 20 and the outlet pipe 21.

Further, according to the heat exchanger 1 having the above configuration, the communication paths 22 communicating the internal spaces 14 of the vertically adjacent heat exchange units 10 with each other and the outflow path 33 respectively are formed by the joint body of the upper and lower joints of the upper and lower through holes as burring holes formed by burring and the upper heat exchange plate 11 or the lower heat exchange plate 12. Therefore, a manufacturing cost can be reduced. Further, a height of the water heater can be reduced.

Further, the water flowing in the internal spaces 14 of the first to sixth heat exchange units 10 flows in the same direction. In addition, the water flowing in the internal spaces 14 of the seventh to eighth heat exchange units 10 flows in the same direction opposite to the direction of the water flowing in the internal spaces 14 of the first to sixth heat exchange units 10. Therefore, since the number of turn-around portions of the path in the heat exchanger 1 is small, water draining performance can also be improved.

In addition, since each of the heat exchange units 10 includes the upper and lower heat exchange plates 11, 12 in the substantially oval shape with rounded corners, compared with a case where a rectangular metal plate is used, a gap hardly forms at the corner when joining the upper and lower heat exchange plates 11, 12, and poor joining is unlikely to occur. In addition, since the combustion chamber 2 above the heat exchanger 1 can also be formed in the substantially oval shape, a casing of the combustion chamber 2 can be formed of less metal plates with few junctions. As a result, a manufacturing process can be simplified, and a manufacturing cost can be reduced. Further, an installation space can be decreased. Note that each of the heat exchange units 10 may be formed by superimposing the upper and lower heat exchange plates 11, 12 having a substantially elliptical shape or a substantially circular shape in a plane view.

In the present embodiment, the drain receiver 40 that covers the heat exchanger 1 from below is continuously connected to a lower edge of the heat exchanger 1. The drain receiver 40 is made of stainless steel-based metal, for example. One side end of the drain receiver 40 communicates with the exhaust duct 41. Therefore, the combustion exhaust gas passing through the heat exchanger 1 flows out to the exhaust duct 41 through the drain receiver 40. In addition, a drain discharge port 42 is formed in vicinity of an opening portion, which is open to the exhaust duct 41. The drain discharge port 42 is connected to a drain neutralizer (not shown).

The inlet pipe 20 and the outlet pipe 21 penetrate a bottom surface of the drain receiver 40 and extend downward. Since acidic drain generated in the heat exchanger 1 flows downward along the inlet pipe 20 and the outlet pipe 21, the drain tends to concentrate in penetrating portions of the inlet pipe 20 and the outlet pipe 21 penetrating the drain receiver 40. As a result, corrosion tends to occur when the acidic drain retains in the penetrating portions. However, the bottom surface of the drain receiver 40 has an inclined surface inclined downward from the penetrating portions of the inlet pipe 20 and the outlet pipe 21 toward the drain discharge port 42. Therefore, the drain hardly retains in the penetrating portions, and the drain can be smoothly discharged to the outside.

Figure 6:
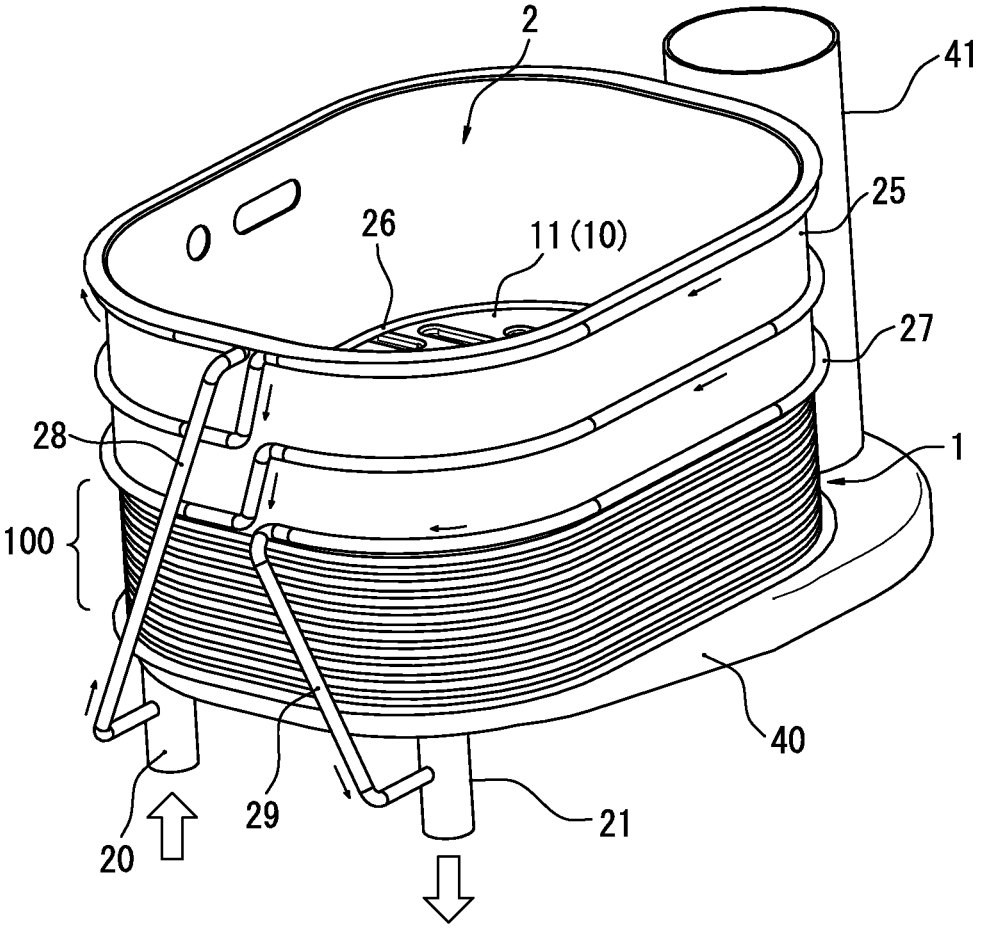
FIG. 6 is a schematic partial perspective view showing one example of a structure of a winding pipe wound around an outer surface of a combustion chamber in the heat source device according to the embodiment of the present invention.

As shown in FIG. 6, one ends of first and second bypass pipes 28, 29 are connected to the inlet pipe 20 and the outlet pipe 21 led out from the drain receiver 40 to the outside, respectively. Other ends of the first and second bypass pipes 28, 29 are respectively connected to an upstream end and a downstream end of a winding pipe 27 wound around an outer surface of a peripheral wall 25 of the combustion chamber 2. Accordingly, the water flowing in the inlet pipe 20 flows into the winding pipe 27 through the first bypass pipe 28 branching from the inlet pipe 20 before being heated by the heat exchanger 1. Further, the water flowing in the winding pipe 27 passes through the second bypass pipe 29 and joins the water heated by the heat exchanger 1. Thereby, the peripheral wall of the combustion chamber 2 can be efficiently cooled with low-temperature water. Since the winding pipe 27 is wound around the outer surface of the peripheral wall 25 of the combustion chamber 2, the winding pipe 27 can be prevented from contacting with the flame of the burner 31 and the combustion exhaust gas ejected from the burner 31. In addition, since the water flowing in the winding pipe 27 is heated by the heat of the peripheral wall 25 of the combustion chamber 2, it is possible to efficiently heat the water. As a result, combustion performance and thermal efficiency can be further improved.

Figure 7:
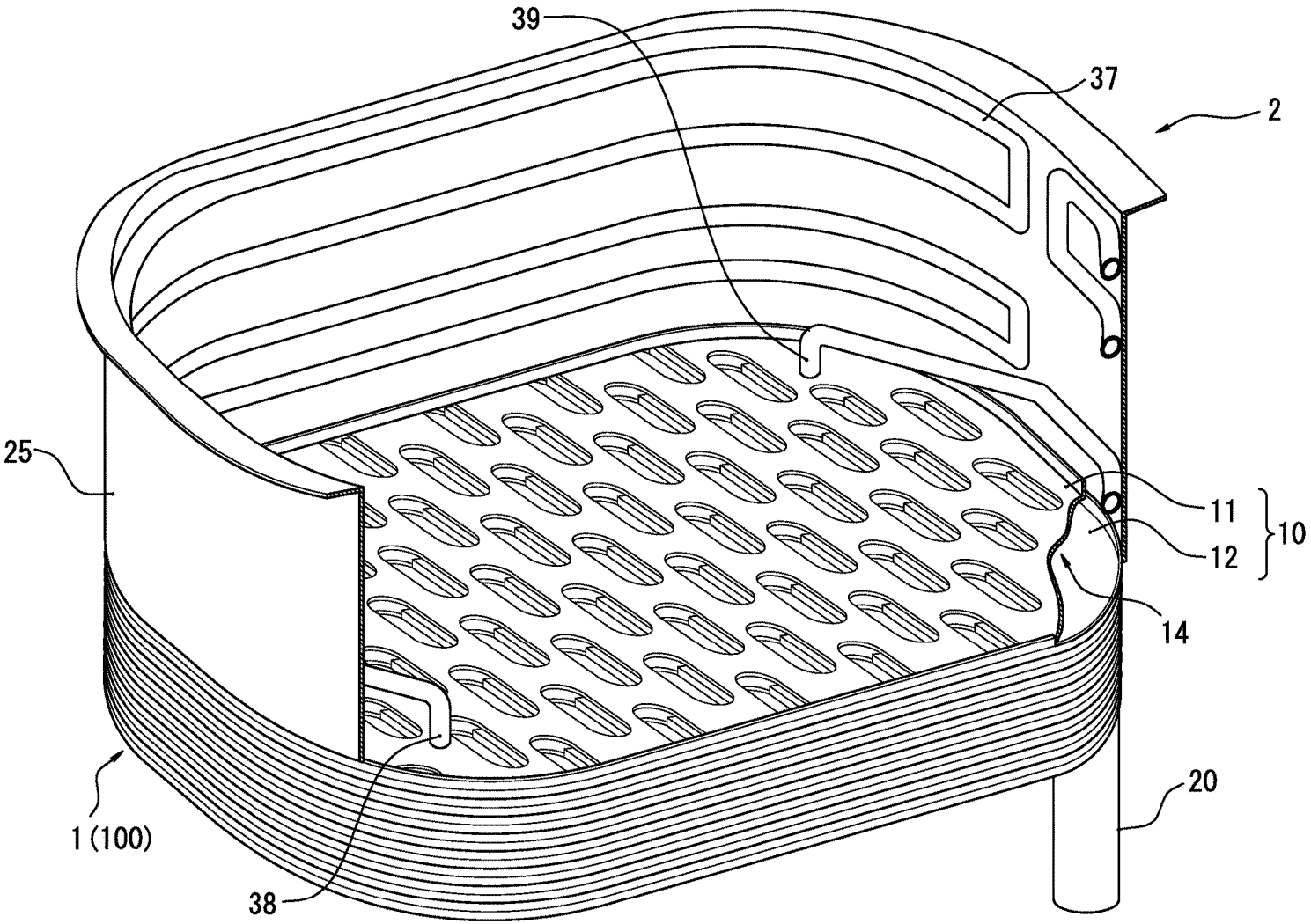
FIG. 7 is a schematic partial perspective view showing another example of a structure of a winding pipe wound around an inner surface of a combustion chamber in the heat source device according to the embodiment of the present invention.

As shown in FIG. 7, a winding pipe 37 may be wound around an inner surface of the peripheral wall 25 of the combustion chamber 2. In this case, an upstream end and a downstream end of the winding pipe 37 are respectively connected to first and second connecting pipes 38, 39 communicating with the internal space 14 of the uppermost heat exchange unit 10. According to this configuration, since the winding pipe 37 communicates with the internal space 14 of the uppermost heat exchange unit 10, water heated by the heat exchanger 1 flows in the winding pipe 37. Therefore, even if the winding pipe 37 is disposed within the combustion chamber 2, a temperature drop of the flame and the combustion exhaust gas of the burner 31 is less than that of a case where the inlet pipe 20 is disposed in the combustion chamber 2. In addition, since the water is efficiently heated by heat of the combustion chamber 2, combustion performance and thermal efficiency can be improved.

However, if the winding pipe 27 communicating with the inlet pipe 20 and the outlet pipe 21 via the first and second bypass pipes 28, 29 is wound around the outer surface of the peripheral wall 25 of the combustion chamber 2, the combustion chamber 2 can be cooled with cooler water. Therefore, the winding pipe 27 having a diameter that is about 30% smaller than a diameter of the winding pipe 37 communicating with the heat exchanger 1 and wound around the inner surface of the peripheral wall 25 of the combustion chamber 2 can be used. Therefore, winding operation becomes easier.

As described above, according to the present invention, the flame and the combustion exhaust gas of the burner 31 can be prevented from coming into contact with the inlet pipe 20 and the outlet pipe 21. Thus, the combustion performance and the thermal efficiency can be improved. In addition, since a pipe having less bent structure can be used for the inlet pipe 20 and the outlet pipe 21, the manufacturing process can be simplified, the manufacturing cost can be reduced, and the water draining performance can also be improved. Further, it is possible to provide a compact heat source device that does not require a large installation space.

In the above embodiment, the internal spaces 14 of the upper two heat exchange units 10 (that is, the seventh and eighth heat exchange units 10) of the stacked body 100 are made to communicate with each other, whereby these heat exchange units 10 constitute the burner side-heat exchange block, and these outlet ports 24 constitute the final outlet ports communicating with the outflow path 33. However, only the uppermost heat exchange unit 10 may constitute the burner side-heat exchange block so that the entire water reaches the uppermost heat exchange unit 10, and only the outlet port 24 of the eighth heat exchange unit 10 may constitute the final outlet port communicating with the outflow path 33. Further, the upper three or more heat exchange units 10 may constitute the burner side-heat exchange block, and these outlet ports 24 may constitute the final outlet ports communicating with the outflow path 33. In addition, a short-circuit flow path may be formed so that a part of water flows from the lowermost heat exchange unit 10 to any optional heat exchange unit 10 above.

In the embodiment above, the water heater is used. However, a heat source device such as a boiler may be used.

Further, in the embodiment above, the burner 31 having the downward combustion surface 30 is disposed above the heat exchanger 1. However, a burner having an upward combustion surface may be disposed below the heat exchanger. In this case, the inlet pipe 20 and the outlet pipe 21 extends upward (that is, the downstream side of the combustion exhaust gas) from the uppermost heat exchanger.

Further, in the embodiment above, the stacked body 100 is formed by stacking the plurality of heat exchange units 10 in the vertical direction. However, the stacked body 100 may be formed by stacking the plurality of heat exchange units 10 in the left-right direction. In this case, the burner having a sideward combustion surface is disposed on one of a left side and a right side of the stacked body, and the inlet pipe 20 and the outlet pipe 21 extends from another side of the stacked body.

Further, in the embodiment above, the vertically adjacent heat exchange units 10 are stacked in such a manner that the exhaust space 15 is formed therebetween. However, the plurality of heat exchange units 10 may be stacked without providing the exhaust space 15.

The outflow path 33 may be formed so as to partially communicate with the internal space 14 of the heat exchange unit 10 located on the downstream side of the gas flow passage of the combustion exhaust gas more than the burner side-heat exchange block. For example, by providing a hole or slit in the flow path 34, a part of the fluid to be heated may flow into the internal space 14 from the flow path 34.

As described in detail, the present invention is summarized as follows.

According to one aspect of the present invention, there is provided a heat exchanger disposed on a downstream side of a gas flow passage of combustion exhaust gas ejected from a burner and connected to an inlet pipe for allowing a fluid to be heated to flow in and an outlet pipe for allowing the fluid to be heated to flow out, the heat exchanger comprising a stacked body formed by stacking a plurality of heat exchange units in a gas flow passage direction of the combustion exhaust gas, wherein each of the plurality of heat exchange units includes:

an internal space in which the fluid to be heated flows, a plurality of gas vents penetrating the internal space in a non-communicating state and through which the combustion exhaust gas passes, at least one inlet port for allowing the fluid to be heated to flow into the internal space, and at least one outlet port for allowing the fluid to be heated to flow out from the internal space, wherein the internal spaces of adjacent heat exchange units communicate with each other via the outlet port of one heat exchange unit and the inlet port of another heat exchange unit, and the inlet pipe and the outlet pipe are provided so as to protrude from a most downstream heat exchange unit located on a most downstream side of the gas flow passage of the combustion exhaust gas, among the plurality of heat exchange units constituting the stacked body, toward the downstream side of the gas flow passage of the combustion exhaust gas.

According to the heat exchanger described above, the plurality of gas vents through which the combustion exhaust gas flows penetrates the internal space of each of the heat exchange units. Further, the stacked body is formed by stacking the plurality of heat exchange units. Therefore, the combustion exhaust gas ejected from the burner flows from an upstream heat exchange unit located on an upstream side of the gas flow passage of the combustion exhaust gas toward a downstream heat exchange unit located on the downstream side of the gas flow passage of the combustion exhaust gas in the stacked body.

On the other hand, since the inlet pipe is connected to the most downstream heat exchange unit located on the most downstream side of the gas flow passage of the combustion exhaust gas, the fluid to be heated flows into the internal space of the most downstream heat exchange unit from the inlet pipe via the inlet port of the most downstream heat exchange unit. Moreover, the internal spaces of the adjacent heat exchange units communicate with each other via the outlet port of the one heat exchange unit and the inlet port of the other heat exchange unit. Therefore, the fluid to be heated flows toward the upstream side of the gas flow passage of the combustion exhaust gas via the inlet port and the outlet port of each of the heat exchange units in the stacked body, and reaches the internal space of the most upstream heat exchange unit located on the most upstream side of the gas flow passage of the combustion exhaust gas. Furthermore, since the outlet pipe is connected to the most downstream heat exchange unit, the flow path direction of the fluid to be heated is folded back in the stacked body and the fluid to be heated flows from the upstream side toward the downstream side of the gas flow passage of the combustion exhaust gas. Then, the fluid to be heated is discharged to the outside of the stacked body from the outlet pipe.

According to the heat exchanger described above, since both the inlet pipe and outlet pipe extend from the most downstream heat exchange unit toward a side opposite to a burner side (that is, the downstream side of the most downstream heat exchange unit located on the most downstream side of the gas flow passage of the combustion exhaust gas), the inlet pipe and the outlet pipe are not provided between the burner and the stacked body. Therefore, flame of the burner and the high temperature combustion exhaust gas before being supplied to the heat exchanger can be prevented from contacting with the inlet pipe and the outlet pipe. Thereby, combustion performance can be improved. Further, since the fluid to be heated flows in the internal space of the most upstream heat exchange unit through which the high temperature combustion exhaust gas passes, it is possible to heat the fluid to be heated with high thermal efficiency.

Preferably, in the heat exchanger described above, at least the most downstream heat exchange unit, among the plurality of heat exchange units constituting the stacked body, has an outflow path penetrating the internal space in a non-communicating state and communicating with the outlet pipe, at least a most upstream heat exchange unit located on a most upstream side of the gas flow passage of the combustion exhaust gas, among the plurality of heat exchange units constituting the stacked body, constitutes a burner side-heat exchange block, and at least the one outlet port of the heat exchange unit constituting the burner side-heat exchange block, among the plurality of heat exchange units constituting the stacked body, communicates with the outflow path.

According to the heat exchanger described above, the fluid to be heated having reached the most upstream heat exchange unit flows out from the outlet pipe to the outside of the stacked body through the outflow path. Further, the outflow path does not communicate with the internal space of at least the most downstream heat exchange. Therefore, high temperature heated fluid flowing in the outflow path is not mixed with low temperature fluid (that is, insufficiently heated fluid) flowing in the internal space of the most downstream heat exchange unit, and flows out to the outlet pipe. Thereby, it is possible to heat the fluid to be heated with high thermal efficiency.

Preferably, in the heat exchanger described above, the burner side-heat exchange block includes the most upstream heat exchange unit and at least a second heat exchange unit of a second layer adjacent to the most upstream heat exchange unit, and the outflow path penetrates the internal space of the most downstream heat exchange unit and internal spaces of intermediate heat exchange units located between the burner side-heat exchange block and the most downstream heat exchange unit in a non-communicated state, and communicates with the outlet pipe.

According to the heat exchanger described above, the fluid to be heated having reached two or more of the heat exchange units constituting the burner side-heat exchange block located on the upstream side of the gas flow passage of the combustion exhaust gas, among the plurality of heat exchange units constituting the stacked body, flows out to the outlet pipe via the outflow path. Specifically, a part of the fluid to be heated necessarily flows in the internal spaces of the most upstream heat exchange unit and the second heat exchange unit. Therefore, it is possible to prevent the fluid to be heated flowing into the stacked body from the inlet pipe from discharging to the outlet pipe without being sufficiently heated. Thereby, it is possible to heat the fluid to be heated with high thermal efficiency.

Preferably, in the heat exchanger described above, each of the heat exchange units has two heat exchange plates being superimposed to form the internal space therebetween, the outflow path is formed by a joint body of at least one burring hole provided at one heat exchange plate and another heat exchange plate.

According to the heat exchanger described above, the outflow path can be formed by joining the two heat exchange plate without involvement of additional joining parts. Therefore, a manufacturing cost can be reduced. Further, a total height of the stacked body can be reduced.

Preferably, in the heat exchanger described above, each of the heat exchange plates has a substantially oval shape, a substantially elliptical shape, or a substantially circular shape.

According to the heat exchanger described above, the metal plate with rounded corners is used. Therefore, a gap hardly forms at the corner, as compared with a rectangular metal plate, and poor joining is unlikely to occur. In addition, when the heat exchanger is continuously connected to the combustion chamber, it is possible to form the combustion chamber having a substantially oval shape, a substantially elliptical shape, or a substantially circular shape. Therefore, the combustion chamber can be formed of less metal plates with few junctions. Thereby, a manufacturing process can be simplified, and a manufacturing cost can be reduced. Further, an installation space can be decreased.

Preferably, in the heat exchanger described above, the burner has a downward combustion surface, the stacked body is disposed below the burner, and the inlet pipe and the outlet pipe are provided so as to protrude from a lowermost heat exchange unit which is the most downstream heat exchange unit located on the most downstream side of the gas flow passage of the combustion exhaust gas toward a lower side which is the downstream side of the gas flow passage of the combustion exhaust gas.

According the heat exchanger of Patent Prior Art 1, in order to lead out the inlet pipe and the outlet pipe protruding from the heat exchanger from an inside to an outside of the combustion chamber, it requires bending outward those pipes at a substantially right angle. Further, when those pipes are respectively connected to a water supply terminal and a hot-water supplying terminal, it requires bending downward the pipes led out from the combustion chamber and further bending in a horizontal direction. As a result, since a piping structure becomes complicated, there are problems that flow resistance becomes large and water drainage performance deteriorates. Further, since a complicated manufacturing process and a plurality of connecters are needed, there are problems that a manufacturing cost increases and an install space becomes large.

On the other hand, since a pipe such as a gas pipe or a water pipe is generally connected to the heat source device from below, a vacant space of a certain size is formed under the stacked body. Therefore, by extending downward the inlet pipe and the outlet pipe from the lowermost heat exchange unit located on the most downstream side of the gas flow passage of the combustion exhaust gas, it is possible to use a pipe having less bent structure and to avoid interference between the pipe and other devices.

According to another aspect of the present invention, there is provided a heat source device comprising:

the heat exchanger described above, a combustion chamber provided between the burner and the heat exchanger, and a winding pipe wound around an outer surface of a peripheral wall of the combustion chamber, wherein an upstream end and a downstream end of the winding pipe respectively communicate with the inlet pipe and the outlet pipe in such a manner that the fluid to be heated flows in the winding pipe.

According to the heat source device described above, the winding pipe for preventing the peripheral wall of the combustion chamber from overheating is would around the outer surface of the peripheral wall of the combustion chamber. Therefore, the winding pipe can be prevented from contacting with the flame of the burner and the combustion exhaust gas ejected from the burner. In addition, since the fluid to be heated flowing in the winding pipe is heated by heat of the peripheral wall of the combustion chamber, it is possible to efficiently heat the fluid to be heated. Thereby, combustion performance and thermal efficiency can be further improved.

According to yet another aspect of the present invention, there is provided a heat source device comprising:

the heat exchanger described above, a combustion chamber provided between the burner and the heat exchanger, and a winding pipe wound around an inner surface of a peripheral wall of the combustion chamber, wherein an upstream end and a downstream end of the winding pipe communicate with the internal space of a most upstream heat exchange unit located on a most upstream side of the gas flow passage of the combustion exhaust gas in such a manner that the fluid to be heated flows in the winding pipe.

According to the heat source device described above, the winding pipe for preventing the peripheral wall of the combustion chamber from overheating communicates with the internal space of the most upstream heat exchange unit of the most upstream side of the gas flow passage of the combustion exhaust gas. Therefore, the fluid to be heated after heated by flowing from the most downstream heat exchange unit to the most upstream heat exchange unit in the heat exchanger flows in the winding pipe. Thus, even if the winding pipe is disposed within the combustion chamber, a temperature drop of the flame and the combustion exhaust gas of the burner can be prevented. In addition, since the fluid to be heated flowing in the winding pipe is heated by heat of the peripheral wall of the combustion chamber, it is possible to efficiently heat the fluid to be heated. Thereby, combustion performance and thermal efficiency can be further improved.

According to further another aspect of the present invention, there is provided a heat source device having the heat exchanger including the inlet pipe and the outlet pipe extending downward, and a drain receiver provided below the heat exchanger, wherein the inlet pipe and the outlet pipe extend downward through a bottom surface of the drain receiver, the drain receiver has a drain discharge port for discharging drain dripping from the heat exchanger to an outside, and the bottom surface of the drain receiver has an inclined surface inclined downward from penetrating portions of the inlet pipe and the outlet pipe toward the drain discharge port.

When the combustion exhaust gas passes through the heat exchanger, acidic drain is generated by condensing moisture in the combustion exhaust gas. On the other hand, when the inlet pipe and the outlet pipe extend downward from the heat exchanger, the acidic drain generated in the heat exchanger flows downward along the inlet pipe and the outlet pipe. Further, the acidic drain is also generated when the combustion exhaust gas comes into contact with the inlet pipe and the outlet pipe. Therefore, in a case where the drain receiver is disposed below the heat exchanger, the acidic drain tends to concentrate in penetrating portions of the inlet pipe and the outlet pipe penetrating the drain receiver. As a result, corrosion tends to occur when the acidic drain retains in the penetrating portions. However, according to the heat source device, the bottom surface of the drain receiver has the inclined surface inclined downward from the penetrating portions of the inlet pipe and the outlet pipe toward the drain discharge port and accordingly, the drain hardly retains in the penetrating portions, and the drain can be smoothly discharged to the outside.

The present application claims a priority based on a Japanese Patent Application No. 2018-82164 filed on Apr. 23, 2018, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A heat exchanger disposed on a downstream side of a gas flow passage of combustion exhaust gas ejected from a burner and connected to an inlet pipe for allowing a fluid to be heated to flow in and an outlet pipe for allowing the fluid to be heated to flow out, the heat exchanger comprising a stacked body formed by stacking a plurality of heat exchange units in a gas flow passage direction of the combustion exhaust gas, wherein each of the plurality of heat exchange units includes:

an internal space in which the fluid to be heated flows, a plurality of gas vents penetrating the internal space in a non-communicating state and through which the combustion exhaust gas passes, at least one inlet port for allowing the fluid to be heated to flow into the internal space, and at least one outlet port for allowing the fluid to be heated to flow out from the internal space, wherein the internal spaces of adjacent heat exchange units communicate with each other via the outlet port of one heat exchange unit and the inlet port of another heat exchange unit, and the inlet pipe and the outlet pipe are provided so as to protrude from a most downstream heat exchange unit located on a most downstream side of the gas flow passage of the combustion exhaust gas, among the plurality of heat exchange units constituting the stacked body, toward the downstream side of the gas flow passage of the combustion exhaust gas.

2. The heat exchanger according to claim 1, wherein at least the most downstream heat exchange unit, among the plurality of heat exchange units constituting the stacked body, has an outflow path penetrating the internal space in a non-communicating state and communicating with the outlet pipe, at least a most upstream heat exchange unit located on a most upstream side of the gas flow passage of the combustion exhaust gas, among the plurality of heat exchange units constituting the stacked body, constitutes a burner side-heat exchange block, and at least the one outlet port of the heat exchange unit constituting the burner side-heat exchange block, among the plurality of heat exchange units constituting the stacked body, communicates with the outflow path.

3. The heat exchanger according to claim 2, wherein the burner side-heat exchange block includes the most upstream heat exchange unit and at least a second heat exchange unit of a second layer adjacent to the most upstream heat exchange unit, and the outflow path penetrates the internal space of the most downstream heat exchange unit and internal spaces of intermediate heat exchange units located between the burner side-heat exchange block and the most downstream heat exchange unit in a non-communicated state, and communicates with the outlet pipe.

4. The heat exchanger according to claim 2, wherein each of the heat exchange units has two heat exchange plates being superimposed to form the internal space therebetween, the outflow path is formed by a joint body of at least one burring hole provided at one heat exchange plate and another heat exchange plate.

5. The heat exchanger according to claim 4, wherein each of the heat exchange plates has a substantially oval shape, a substantially elliptical shape, or a substantially circular shape.

6. The heat exchanger according to claim 1, wherein the burner has a downward combustion surface, the stacked body is disposed below the burner, and the inlet pipe and the outlet pipe are provided so as to protrude from a lowermost heat exchange unit which is the most downstream heat exchange unit located on the most downstream side of the gas flow passage of the combustion exhaust gas toward a lower side which is the downstream side of the gas flow passage of the combustion exhaust gas.

7. A heat source device comprising:

the heat exchanger according to claim 1, a combustion chamber provided between the burner and the heat exchanger, and a winding pipe wound around an outer surface of a peripheral wall of the combustion chamber, wherein an upstream end and a downstream end of the winding pipe respectively communicate with the inlet pipe and the outlet pipe in such a manner that the fluid to be heated flows in the winding pipe.

8. A heat source device comprising:

the heat exchanger according to claim 1, a combustion chamber provided between the burner and the heat exchanger, and a winding pipe wound around an inner surface of a peripheral wall of the combustion chamber, wherein an upstream end and a downstream end of the winding pipe communicate with the internal space of a most upstream heat exchange unit located on a most upstream side of the gas flow passage of the combustion exhaust gas in such a manner that the fluid to be heated flows in the winding pipe.

9. A heat source device comprising:

the heat exchanger according to claim 6, and a drain receiver provided below the heat exchanger, wherein the inlet pipe and the outlet pipe extend downward through a bottom surface of the drain receiver, the drain receiver has a drain discharge port for discharging drain dripping from the heat exchanger to an outside, and the bottom surface of the drain receiver has an inclined surface inclined downward from penetrating portions of the inlet pipe and the outlet pipe toward the drain discharge port.

* * * * *